United States Patent [19]

Deike

[11] 4,044,513

[45] Aug. 30, 1977

[54] EARTH ANCHOR

[75] Inventor: Robert F. Deike, Cheyenne, Wyo.

[73] Assignee: Foresight Industries, Cheyenne, Wyo.

[21] Appl. No.: 668,695

[22] Filed: Mar. 19, 1976

Related U.S. Application Data

[63] Continuation-in-part of Ser. No. 535,428, Dec. 23, 1974, Pat. No. 3,969,854.

[51] Int. Cl.[2] ..... E02D 5/80; E02D 5/58

[52] U.S. Cl. ..... 52/163; 61/45 B; 61/53.68

[58] Field of Search ..... 52/166, 165, 163, 162, 52/164, 155; 61/53.68, 45 B

[56] References Cited

U.S. PATENT DOCUMENTS

| | | | |
|---|---|---|---|
| 631,168 | 8/1899 | Langston | 52/155 |
| 660,667 | 10/1900 | Swartz | 61/53.68 |
| 722,778 | 3/1903 | Wantling | 52/155 |
| 768,705 | 8/1904 | Swan | 52/163 |
| 936,824 | 10/1909 | Simpson | 52/163 |
| 1,014,806 | 1/1912 | Burns | 52/163 |
| 1,052,700 | 2/1913 | Warrick | 52/163 |
| 1,245,176 | 11/1917 | Beard | 52/163 |
| 1,564,069 | 12/1925 | Hoovers | 52/163 |
| 3,066,769 | 12/1962 | Pasquale | 52/165 |

*Primary Examiner*—Price C. Faw, Jr.
*Assistant Examiner*—Henry Raduazo
*Attorney, Agent, or Firm*—Hill, Gross, Simpson, Van Santen, Steadman, Chiara & Simpson

[57] ABSTRACT

An elongated tubular ground anchor having a leading driving end with an internal impact receiving abutment and a tapered out-turned trailing end has an external cable swingably secured thereto about midway between said ends but rearwardly of the center of mass of the anchor, is guided and driven lengthwise into the ground to a desired depth by a ram entering the trailing end and impacting the abutment with the cable extending above ground from the hole in the ground formed by the anchor and driving ram. The cable is pulled or tensioned causing the trailing end of the anchor to plow into the ground forming a fulcrum to rotate or tilt the anchor from its upright driving position to an inclined position transversely of the hole and with the leading end remaining lower than the trailing end. The driving ram may be hollow and a concrete slurry pumped through the ram as it is retracted from the anchor and hole to fill the hole with the cable surrounded by the slurry. A plug may then be pressed into the hole to compress the concrete slurry causing it to flow into crevices and pores of the ground surrounding the hole and concrete may then be poured into the hole above the plug while the cable is held under tension. After the concrete sets, a tensioned cable reinforced column of concrete fills the hole and cooperates with the anchor to provide a firmly secured ground anchored cable. The cable anchor may be further strengthened by swaging an entrance hole of larger diameter than the hole formed by driving the anchor in the ground but only extending to a depth substantially less than the depth to which the anchor is driven. This large diameter entrance hole is thereby surrounded by compacted earth due to the swaging operation and may be lined with a tube to keep the hole in an open condition during the driving of the anchor. The liner is withdrawn and the entrance hole is also filled with concrete which is pressed by the plug thus forming a concrete column interlocked with the ground and embedding the anchor and cable.

10 Claims, 12 Drawing Figures

G
A
A'
E.H.
T
N
XII
41
42
D
M
11
33a
33
32
K
B
10
42a
43
43a
44
39
37
40
35
34
38
36
31
H
20
13
C
16
29
30
22
28
24
IX

EARTH ANCHOR

RELATED APPLICATION

This application is a continuation-in-part of my U.S. patent application entitled, "Planing Fin Anchor," Ser. No. 535,428, filed Dec. 23, 1974, now U.S. Pat. No. 3,969,854 issued July 20, 1976.

FIELD OF THE INVENTION

This invention relates to the art of anchoring cables in the ground with tubular anchors that are driven lengthwise into the ground to a desired depth, pulling the cable therewith, and then tilted transversely of the hole by tensioning the cable. The cable is further anchored in the ground by concrete poured therearound filling the hole and preferably pressed into the hole to flow into voids and pores in the ground surrounding the hole.

BRIEF SUMMARY OF THE INVENTION

In my aforesaid U.S. patent application, Ser. No. 535,428, filed Dec. 23, 1974, now U.S. Pat. No. 3,969,854. I have disclosed and claimed a ground anchor for cables which is generally T-shaped having out-turned flanges and a central longitudinal web to which the cable is attached. This T-shaped anchor is either dropped into a pre-formed hole in the ground or is driven into the ground by impacting its trailing end. I have now improved this type of ground anchor by providing a hollow tubular anchor which is driven into the ground from its leading end and is held in the desired upright position by a driving ram which receives the anchor therearound thus insuring the formation of a straight hole and preventing the anchor from tilting prior to reaching its desired depth. An important feature of the invention is the filling of the hole above the anchor with concrete, the pressing of the concrete in the hole to spread out laterally filling voids and pores in the ground and forming tentacles and fins increasing the anchor grip. Another important feature is the tensioning of the cable during the setting of the concrete so that the concrete column filling the hole is compressively stressed increasing its column strength.

Therefore, an object of this invention is to improve ground anchors of the type disclosed in may aforesaid U.S. patent application, Ser. No. 535,428, filed Dec. 23, 1974, now U.S. Pat. No. 3,969,854.

Another object of this invention is to provide hollow ground anchors which are driven lengthwise into the ground from their leading ends and are then tilted into transverse position extending across the hole into which they are driven.

A further object of the invention is to provide hollow cable anchors which are driven lengthwise into the ground by a ram receiving the anchor therearound and impacting against the leading end of the anchor.

A specific object of the invention is to increase the anchoring capacity of ground anchors for cables by filling the hole above the anchor around the cable with concrete and compressing the concrete to force it into the ground surrounding the hole thereby forming tentacles and fins locked in the ground.

Other and further objects of this invention will become apparent to those skilled in this art from the following detailed description of the annexed sheets of drawings which, by way of a preferred example only, illustrate one embodiment of the invention.

ON THE DRAWINGS

AS SHOWN ON THE DRAWINGS

Figure 1:
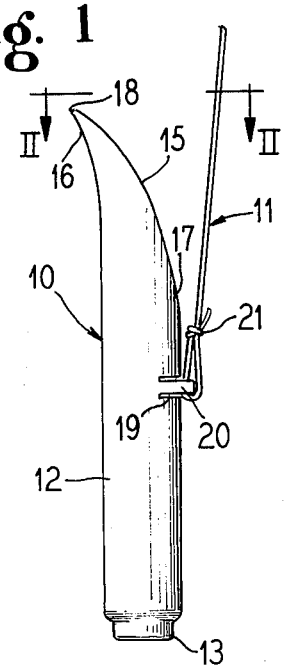
FIG. 1 is a side elevational view of the tubular ground anchor of the invention showing a cable attached thereto.
Figure 3:
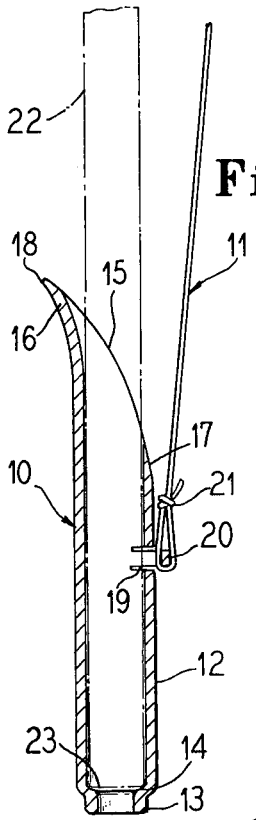
FIG. 3 is a longitudinal cross-sectional view of the ground anchor of FIG. 1 showing a driving ram inserted therein for guiding the anchor and impacting against the leading end thereof.
Figure 2:
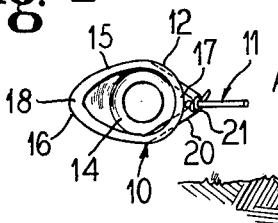
FIG. 2 is a top plan view of the anchor and cable of FIG. 1 taken along the lines II—II of FIG. 1.

The ground anchor 10 of this invention is attached to an external cable 11 about midway between its ends as shown in FIGS. 1 to 3. The anchor 10 is composed of a metal tube 12 with a reduced diameter leading driving end 13 providing an internal abutment shoulder 14, and with a tapered trailing end 15 having an out-turned lip 16. The tube 12 is cut or ground off from a level 17 along an arcuate path to the rounded tip end 18 of the lip 16. The tube is lanced transversely at 19 below the bottom end 17 of the tapered trailing end 15 and a kerf is pressed outwardly from the lanced section 19 to provide a rigid bail-like strap 20 around which cable 11 is tied as shown at 21. The anchoring strap 20 for the cable 11 is positioned on the opposite side of the tube body 12 from the lip 16 and rearwardly of the transverse center of mass of the tube 12 so that when the anchor is freely suspended from the cable, its leading end 12 will tilt downwardly at an angle of about 15° from the horizontal. Since the tapered traling end 15 has less metal along its length than the leading end 13, the strap 20 may be positioned about midway between the leading end 13 and the tip 18 and still leave most of the mass forwardly of the strap so that the freely suspended anchor wil tilt with its leading end downwardly.

The anchor 10 may vary greatly in diameter, length and thickness depending upon the load it is to carry and the soil conditions of the ground in which it is to be driven. Typical anchor lengths will vary from 2 inches to about 20 inches and typical anchor diameters will vary from about ¼ to 3 inches. The wall thickness may vary from 1/16 to ¼ of an inch. The angle of the tapered end 15 is less than 45° to provide an elongated lip or bill contour. Angles of about 15 to 30° are preferred.

The leading end 13 of the anchor 10 may be an integral contracted end of the metal tube 12 or may be a welded-on head of hardened steel contrasted with the tubular steel body 12. If desired, the leading end may be closed and provided with a driving point.

Figure 4:
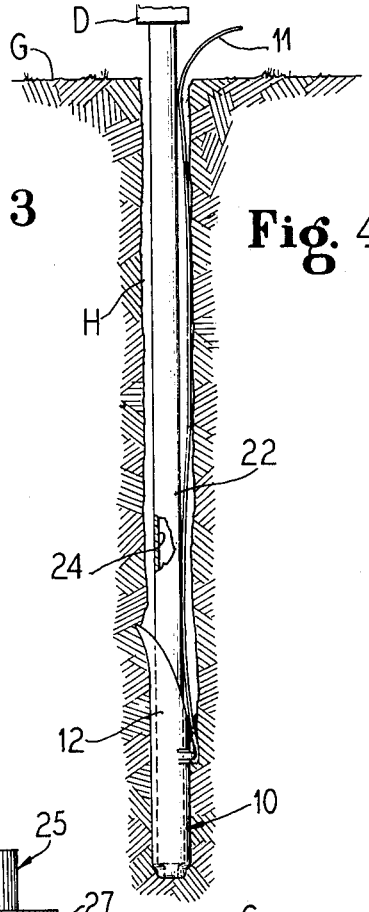
FIG. 4 is a side elevational view showing the manner in which the ground anchor of FIGS. 1 to 3 is driven into the ground and showing the ground surrounding the driven hole in longitudinal section.

As shown in FIGS. 3 and 4, the tube 12 slidably receives a driving and guide rod 22 with a leading end 23 adapted to impact against the internal abutment shoulder 14 of the tube. This driving and guide rod 22 may be hollow and have a central bore 24 therethrough as shown in FIG. 4.

As also shown in FIG. 4, the anchor 10 is driven into the ground G by a driver D acting on the top end of the hollow rod 22 and forming a hole H in the ground with the cable 11 extending from the anchor 10 through the hole to a level above the ground.

The rod 22 holds the anchor 10 in upright position parallel with the hole H and prevents the anchor from tilting or wandering out of parallel alignment with the hole that is being formed. The rod 22 may be pressed or repeatedly impacted against the shoulder 14 without being withdrawn from the tubular body 12 to insure maintenance of the anchor in its desired upright position until it has reached a desired depth.

Figure 5:
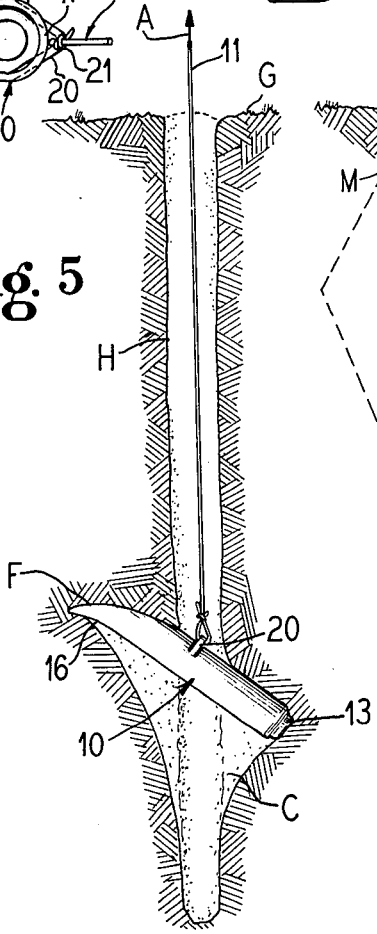
FIG. 5 is a view similar to FIG. 4 but illustrating the tilted position assumed by the ground anchor transversely of the hole when the cable is tensioned.

As shown in FIG. 5, after the anchor 10 has reached a desired depth in the ground G, the driving rod 22 is retracted from the hole H and the cable 11 is pulled in the direction of the arrow A. This tension pull on the cable causes the lip 16 to plough into the ground alongside the hole H forming a fulcrum F for the anchor which will cause the leading end 13 to be pulled upwardly into the ground on the opposite side of the hole whereupon the anchor 10 assumes an inclined position transversely of the hole. This tilting or rotation of the anchor 10 leaves a somewhat enlarged cavity C in the hole H below the anchor, but the leading end 13 and the trailing end 16 of the anchor are firmly embedded in the ground G laterally of the hole H and the cavity C.

Figure 6:
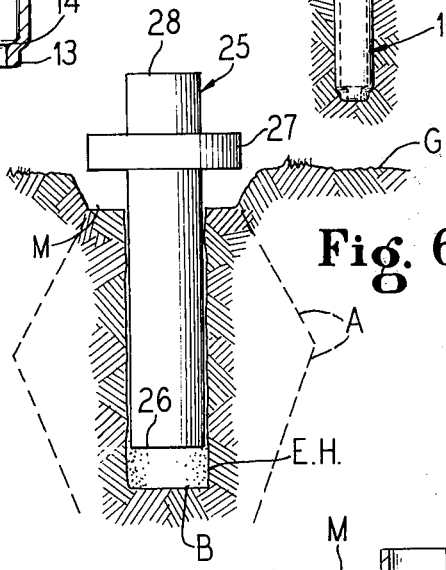
FIG. 6 is a view illustrating the formation of a shallow entrance hole in the ground for the ground anchor by means of an impact swaging tool which compacts the ground surrounding the shallow hole.
Figure 7:
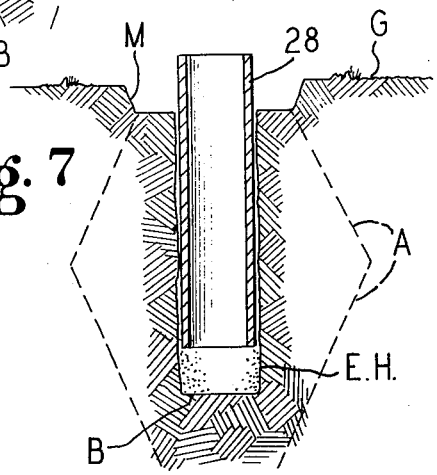
FIG. 7 is a view similar to FIG. 6 but showing the insertion of a tubular liner in the swaged hole to prevent collapsing of the hole during subsequent operations.

FIGS. 6 and 7 show an initial formation of a compacted entrance hole E.H. of larger diameter than the hole H providing a tightly packed area A surrounding the hole. This entrance hole E.H. is conveniently formed by a swage tool 25 with a flat leading end 26 and a surrounding collar 27 adjacent the trailing end 28. The trailing end is adapted to be struck by a hammer type driving machine forcing the leading end 26 into the ground G and spreading the ground to accept the tool thereby compacting the ground around the hole that is formed by the tool. The compacted area diverges from ground level to a depth above the bottom of the hole E.H. and then converges toward the bottom of the hole. The collar 27 is impacted against the top of the ground and forms a larger diameter mouth M at the top of the hole E.H.

The tool 25 is of larger diameter than the major transverse diameter of the ground anchor 10 in its upright driving position so that the hole E.H. will be of larger diameter than the hole H. The depth of the hole E.H. will vary with the type of surrounding soil with a lesser depth being sufficient for dense heavy soil. The depth of the hole E.H. is substantially less than the depth of the hole H. The hole E.H. will have a flat bottom B.

As shown in FIG. 7, a metal or plastic tube 28 is dropped into the hole E.H. to form a liner preventing collapse of the hole especially in sand or gravel soil conditions. The tube 28 provides a liner which holds the area A of compacted soil.

Figures 8, 9, 10, 11, 12:
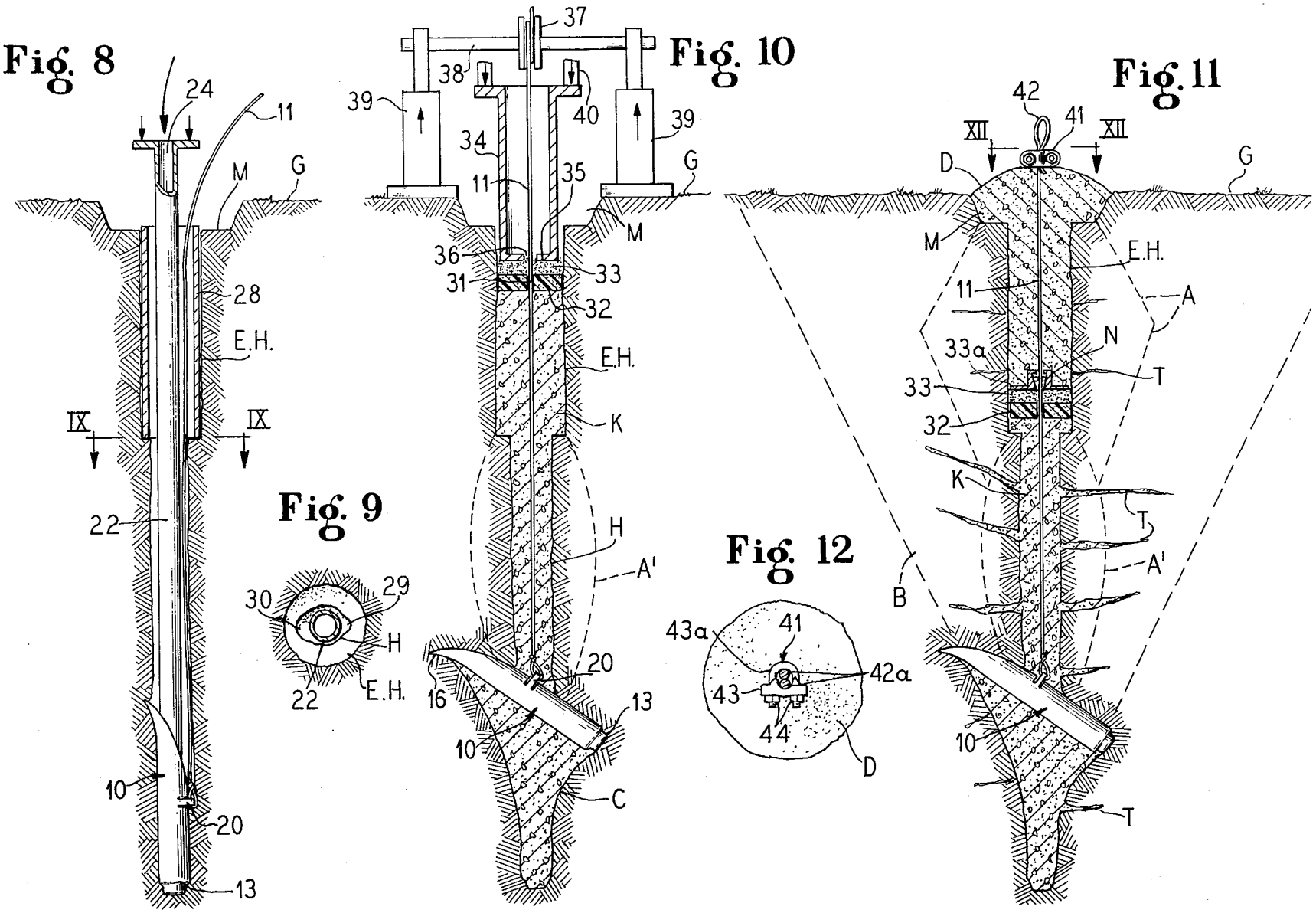
FIG. 8 is a view similar to FIG. 4 but also showing a swaged entrance hole lined with the tube of FIG. 7.
FIG. 9 is a transverse sectional view along the lines IX—IX of FIG. 8.
FIG. 10 is a view similar to FIG. 8 but showing the filling of the swaged and driven holes with concrete and the compressing of the concrete around the cable.
FIG. 11 is a view similar to FIG. 10 but illustrating the concrete filled hole in finished condition.
FIG. 12 is a transverse sectional view along the lines XII—XII of FIG. 11.

As shown in FIG. 8, the hollow driving ram 22 extends freely through the liner tube 28 and into the anchor 10. As illustrated in FIG. 8, the anchor 10 has been driven to its desired depth below the entrance hole E.H. and remains in its upright driving position on the end of the ram 22.

As shown in FIG. 9, the entrance hole E.H. is circular in cross-section while the hole H has a small circular cross-section with diametrically opposed grooves 29 and 30 formed respectively by the strap 20 and cable 11 on one side of the anchor 10 and the out-turned lip 16 on the opposite side of the anchor. The groove 29 is somewhat smaller than the groove 30.

After the ram 22 has driven the anchor 10 to its desired depth it is retracted from the anchor and the cable 11 is pulled to rotate the anchor transversely of the hole H to the inclined position of FIG. 10. A fluid concrete slurry is then poured or pumped through the hollow interior 24 of the ram 22 to be forced into the bottom of the hole H and fill the cavity C below the tilted anchor 10. The ram 22 is gradually retracted from the hole H as concrete fills the hole H. The plastic or metal liner tube 28 is withdrawn from the entrance hole E.H. and this hole is also filled with concrete. The ram 22 may be withdrawn from the hole E.H. as the tube 28 is withdrawn so that concrete fills the enlarged hole without permitting any of the surrounding soil to drop into the hole.

The cable 11 is threaded through the central aperture 31 of a circular plug 32 tightly fitting the hole E.H., the plug is pushed into the hole E.H. thereby centering the cable in the column of concrete below the plug. The plug 32 is preferably composed of material which expands under compression, such as styrofoam, so that the plug will fit tightly in the hole E.H. A layer of sand 33 is next deposited in the hole E.H. above the plug 32 to form a seal and a pressing tool 34 of smaller diameter than the hole E.H. has a flat bottom face 35 resting on the sand 33 with a central aperture 36 freely receiving the cable 11 therethrough. The cable 11 passes through the tool 34 and is anchored around a pulley 37 carried by a cross member 38 supported by jacks 39 resting on the ground G. These jacks 39 raise the pulley 37 to tension the cable 11. A downward load 40 is then placed on the tool 34 to force it into the hole E.H. thereby compressing the column K of concrete beneath the plug and forming a second compacted ground area A' around the hole H. As the plug 32 is forced toward the bottom of the hole E.H., concrete from the column K is forced laterally of the alligned holes E.H. and H to form laterally extending fins or tentacles T as shown in FIG. 11. These lateral tentacles interlock with the soil surrounding the holes to prevent the column of concrete K from shifting in the ground.

The concrete below the depressed plug 32 is held under compression by placing a plate or cover **33*a* on the sand seal 33, threading the cable 11 through the plate and through a lock nut N, pressing the nut against the plate and tensioning the cable in the nut. The nut N will grip the cable to keep it under tension and to press the plug 32 against the underlying concrete column K. The tensioned cable between the anchor 10 and plug 32** will compressibly load the concrete as it sets to form a compression loaded concrete column K. Maintenance of the compression load on the concrete is especially useful in expansion soil conditions such as wet clay to anchor the concrete in the hole H.

As also shown in FIG. 11, the concrete tentacles T fill all of the voids in the ground and a diverging cone B of soil extends from the anchor 10 around the compacted areas A and A' to the ground level. This cone B shows the large plug or mass of soil that would have to be displaced before the concrete column K and the ground anchor 10 could be lifted. As also illustrated in FIG. 11, the hole E.H. above the depressed plug 32 and sand seal 33 is also filled with concrete as is the mouth M. The concrete in the mouth M can be built up above ground level to form a dome D.

The length of the cable 11 above the nut N is preferably also maintained under tension as the concrete sets and a clamp 41 is secured around a looped end 42 of the cable 11 resting on the dome D of the concrete column in the entrance hole E.H. As shown in FIG. 12, this clamp 41 is composed of a bracket and U-bolt 43 receiving therebetween the legs 42*a* of the looped end 42 of the cable 11 and drawn together by draw bolts 44 to hold the loop closed. When tension on the cable 11 is released, the clamp 41 will seat firmly on the dome D of the column of concrete and the concrete column in the entrance hole E.H. will be held under compression between the anchor 10 and the plate 33*a*.

The looped end 42 of the cable can be attached to guy wires, ground plates or the like to firmly anchor above ground structures to the ground.

The ground anchor 10, the ground compacting and concrete pressurizing together with the tensioned cable locked in a column of concrete provides a superior anchor assembly which will not heave or shift during freezing or under load and which forms large shear planes in the ground above the anchor resisting retraction of the anchor.

The anchors of this invention are relatively light in weight, inexpensive and easy to install.

It should be understood that the term "cable" as used herein and in the claims includes chains, wires, rods, ropes and the like as well as conventional cables.

I claim as my invention:

1. A ground anchor which comprises an elongated rigid hollow tubular member having a leading driving end with an internal abutment adapted to be impacted by a driving tool and an open trailing end with an out-turned lip on one side thereof, an external cable anchor intermediate said ends on the side of the member opposite said lip side, said cable anchor being positioned rearwardly of the center of mass of the member so that when the member is suspended from a cable attached to the anchor, the leading end of the member will be at a lower level than the trailing end, said member adapted to slidably receive a driving and guiding tool for impacting against said abutment to drive the member and guide it upright into the ground, and said member when driven into the ground to a desired depth adapted to be rotated about said lip and plow laterally into the ground when a cable attached to the cable anchor is tensioned.

2. A ground anchor comprising a hollow tubular member having a driving end, an internal abutment in said member adjacent said driving end adapted to be impacted by a driving tool slidably received in the member to hold the member aligned with the tool and to force the member lengthwise into the ground, said member having an open trailing end with an out-turned lip formed as a continuation of the tubular member on one side forming a fulcrum for tilting and plowing the member laterally into the ground, and a cable anchor on the side of the member opposite the lip side and intermediate the ends of the member.

3. The anchor of claim 1 wherein the open trailing end tapers from a level adjacent the cable anchor to the tip of the tapered lip.

4. The anchor of claim 1 wherein the lip has a rounded tapered end.

5. The anchor of claim 1 wherein the cable anchor is a kerf lanced from the member.

6. The anchor of claim 2 wherein the open trailing end is longitudinally tapered from the out-turned lip to the opposite side of the member adjacent the cable anchor.

7. The anchor of claim 2 wherein the outturned lip is arcuate.

8. The anchor of claim 2 wherein the internal abutment adjacent the driving end is a shoulder.

9. A ground anchor which comprises a elongated rigid hollow tubular member lying transversely in a hole in the ground and having an out-turned lip on one end thereof plowed into the ground adjacent the hole, a cable having one end secured to said tubular member intermediate the ends of the tubular member and extending through the central portion of the hole to a level above the ground, a column of concrete filling said hole in the ground surrounding said cable and tubular member, a plug surrounding said cable overlying said concrete, and means tensioning said cable and compressing said concrete column forcing concrete into voids in the ground surrounding the hole and providing anchoring tentacles for the concrete column.

10. A ground anchor formed in situ in the earth comprising, in combination with a hole formed in the earth, a tubular metal member, a cable suspending said member in the hole in the earth at a desired depth, said member having an out-turned lip at one end thereof plowed into the earth adjacent said hole to tilt the member transversely of the hole, a column of concrete filling said hole surrounding said cable and said member, means compressing said concrete column and tensioning said cable, and said column having fins extending from the hole into the ground forming anchors for the column.

* * * * *